US006114901A

United States Patent [19]

Singh et al.

[11] Patent Number: 6,114,901

[45] Date of Patent: Sep. 5, 2000

[54] BIAS STABILIZATION CIRCUIT

[75] Inventors: Rajinder Singh; Hiroshi Nakamura, both of Singapore, Singapore

[73] Assignee: Institute of Microelectronics, Singapore, Singapore

[21] Appl. No.: 08/974,288

[22] Filed: Nov. 19, 1997

[30] Foreign Application Priority Data

Sep. 2, 1997 [SG] Singapore ..... 9703202

[51] Int. Cl.[7] ..... G05F 1/10

[52] U.S. Cl. ..... 327/543

[58] Field of Search ..... 323/312, 313, 323/314; 327/534, 535, 537, 538, 543, 545, 546

[56] References Cited

U.S. PATENT DOCUMENTS

| | | | |
|---|---|---|---|
| 4,686,451 | 8/1987 | Li et al. | 323/313 |
| 4,810,907 | 3/1989 | Tohyama | 307/475 |
| 4,868,416 | 9/1989 | Fitzpatrick et al. | 307/296.8 |
| 4,904,885 | 2/1990 | Yamada et al. | 307/296.2 |
| 5,041,893 | 8/1991 | Nagai et al. | 357/41 |
| 5,319,604 | 6/1994 | Imondi et al. | 365/230.06 |
| 5,488,327 | 1/1996 | Okada | 327/536 |
| 5,825,695 | 10/1998 | Hamaguchi | 365/189.09 |

OTHER PUBLICATIONS

Malcolm, "Fundamentals of Electronics", PWS Publishers, Boston, pp 94–95, 1987.

*Primary Examiner*—Jeffrey Zweizig

*Attorney, Agent, or Firm*—Proskauer Rose LLP

[57] ABSTRACT

A bias stabilization circuit for biasing the DC gate bias of a stabilized transistor is disclosed. The bias stabilization circuit may be comprised of a bias transistor that is fabricated concurrent with, and on the same chip as, the stabilized transistor. Preferably, the bias transistor and the stabilized transistor are fabricated physically close to each other and during the same process so that the electrical characteristics of the transistors are closely related. In a preferred embodiment, a drain of the bias transistor is connected to a load comprising a first resistor, a second resistor, and a third resistor. The drain of the bias transistor is connected through the third resistor to a junction between the first and second resistors. The first and second resistors are connected in series between a first supply potential and a reference potential. The gate and source of the bias transistor are connected together through a fourth resistor. The gate is also connected to a second supply potential that is derived from the first supply potential. The third and fourth resistors are fabricated together with the bias and stabilized transistors. By this configuration, if the operating characteristics of the stabilized transistor varies from chip to chip during fabrication due to process variations, or the supply potentials vary, the bias transistor will compensate to maintain a substantially constant operating point of the stabilized transistor.

17 Claims, 4 Drawing Sheets

BIAS STABILIZATION CIRCUIT

FIELD OF THE INVENTION

This invention generally relates to electronic circuits and specifically relates to a bias stabilization circuit.

BACKGROUND OF THE INVENTION

The DC gate bias of a field effect transistor ("FET") affects the DC and AC operating characteristics of the transistor. It is desirable that FETs which are fabricated into integrated circuits ("ICs") exhibit predetermined DC and AC operating characteristics. The power drain caused by the bias current is one of the major DC characteristics that needs to be predictable and well stabilized. The AC operating characteristics of the FETs in an IC affect circuit characteristics such as the gain of the circuit. Yet, when the FETs are fabricated, there are variations in the physical characteristics which are unavoidably introduced due to variations in the fabrication process and the fabrication material.

FIG. 1 shows typical current curves for an N-channel depletion mode FET. The curves plot the change in drain to source current ("$I_{DS}$") as a function of the drain to source voltage ("$V_{DS}$"). The curves A, B, and C are for gate to source voltages ("$V_{GS}$") equal to 0 volts, −1 volt, and −2 volts, respectively. As can be seen by all three curves, at first, the $I_{DS}$ increases as the $V_{DS}$ increases. This behavior continues up to a point called the pinch off voltage ("Vpoff") of the FET. After the Vpoff, the $I_{DS}$ tends to level off until the breakdown voltage ("$V_B$") is reached. When the $V_{DS}$ Of the FET is between the Vpoff and the $V_B$, the FET is operating in the saturation region. In the saturation region, the $I_{DS}$ is called the saturation current. In typical applications, such as a power amplifier ("PA"), an FET is biased to operate within the saturation region.

As can be seen by the curves A, B, and C in FIG. 1, the saturation current, the Vpoff and the $V_B$ of the FET are a function of the $V_{GS}$. Consequently, the $V_{GS}$ may be used to compensate for variations in the operating characteristics generally, and the DC characteristics particularly, of an FET that may occur due to variations in the fabrication process. Variations in characteristics such as dopant concentration, uniformity of the layers making up the FET, and the length and width of the gate electrode from wafer to wafer or lot to lot may introduce variations in the operating characteristics of an FET. These variations in the operating characteristics of the FET may be manifested as a change in the Vpoff and thereby, the saturation current of the FET for a given bias condition (e.g., a fixed gate to source and drain to source voltage).

When an FET has a saturation current that deviates from a desired value for a specified $V_{GS}$, the $V_{GS}$ may be adjusted to compensate for this variation. By appropriately adjusting ("tuning") the DC bias (e.g., the $V_{GS}$) of the FET, the $I_{DS}$ may be adjusted back to the desired level. This can help stabilize the input and output characteristics of a circuit in which the FET is incorporated.

This adjustment can be done experimentally by measuring the input and output characteristics of a given circuit and then appropriately tuning the FET's bias to produce a desired result. The problem with this technique is that each integrated circuit may need to be individually tuned to compensate for the fabrication variations. This is a very cumbersome and time consuming task which unacceptably increases the cost of fabricating the ICs into which the FETs are incorporated. Further, additional pin outputs on the IC may be required to tune properly an IC. This may be unacceptable in applications where additional pin outputs are already limited due to other IC constraints.

In the prior art, a bias stabilization circuit allegedly may compensate for variations in a transistor's (e.g., a stabilized transistor) operating characteristics without requiring tuning. However, a practical bias circuit in a production environment should stabilize the current with respect to all the possible parameters affecting it. Depending upon the circuit implementation, these parameters could be:

(i) Vpoff variations, (ii) Resistance variations in the resistors that are typically used to control the bias current, (iii) Positive Power supply ("VDD") variations of the bias stabilization circuit, and (iv) Negative Power supply ("VGG") variations of the bias stabilization circuit.

Point (iv) above can be appreciated in light of the fact that in most GaAs technologies, only depletion mode devices are available. To use these devices at an optimum bias level, say for a PA, one often needs a negative power supply. Thus, the PA circuit for instance should be stabilized with respect to the process variations, such as variations in the Vpoff of the transistor and resistance variations in the bias resistors, and with respect to the system variations, such as variations in VDD and VGG of the bias circuit.

In some applications, the bias stabilization circuit may not need VDD to operate. In these cases, a ground pin may be used in the place of a positive power supply for the bias stabilization circuit as shown in U.S. Pat. No. 5,412,235 to Nakajima ("the '235 Patent") discussed in more detail below. This eliminates the need for the circuit to be stabilized with respect to the VDD. However in this case, it may not always be possible to adequately stabilize the DC bias current of the main circuit. Furthermore, in most cases at least the other three parameters are present and variations in those parameters should be compensated for by a bias stabilization circuit that is useful in practical applications.

In addition to the above four parameters, the bias stabilization circuit often has to comply with other system constraints as well. Two such possible system constraints are discussed below:

(i) Considering a PA circuit as an example, for such applications the transistor width (W) of the PA circuit (e.g., the stabilized transistor) is usually very large in relation to the bias transistor. This means that the leakage current from the stabilized transistor's gate may also be large. This can lead to a thermal runaway problem. To avoid such a situation, the bias stabilization circuit should present a relatively low output resistance to the stabilized transistor's input.

(ii) In some applications, such as a PA circuit, a negative voltage is often provided for optimal operation of the circuit. This negative voltage may be generated by a switching inverter circuit. Such circuits only have a limited current sinking capability. A useful bias stabilization circuit must therefore respect this constraint as well.

One prior art method that claims to stabilize the operating characteristics of an amplifier transistor is disclosed in the '235 Patent. The contents of the '235 Patent are incorporated herein by reference.

FIG. 2 shows a gate bias stabilization circuit 200 and an amplifier 210 as disclosed in the '235 Patent. The bias stabilization circuit 200 is comprised of an FET ("a bias transistor 110"), a resistor 114, a resistor 115, a resistor 118 and a resistor 119. The bias transistor 110 is fabricated on the same chip on which an FET ("a stabilized transistor 111") of the amplifier circuit 210 is fabricated. By this method, the fabrication process variations that affect the stabilized transistor 111 will also equivalently affect the bias transistor 110.

In the circuit disclosed in the '235 Patent, the drain (D) of the bias transistor 110 is connected to a first end of the resistor 114 and a gate (G) of the stabilized transistor 111. A second end of the resistor 114 is connected to a ground potential. A source (S) of the bias transistor 110 is connected to a first end of the resistor 115. A second end of the resistor 115 is connected to a negative power supply ("VGG") and a first side of the resistor 119. A second side of the resistor 119 is connected to a gate (G) of the bias transistor 110 and a first side of the resistor 118. A second side of the resistor 118 is connected to a ground potential.

In operation, the drain to source current ("$I_{dpa}$") of the stabilized transistor 111 may vary due to fabrication process variations (see discussion above). This change in $I_{dpa}$ is primarily due to a change in the Vpoff of the stabilized transistor 111. Considering these variations, if the Vpoff is more negative than a desired value due to fabrication process variations, then the drain to source current may tend to be greater than a desired value in both the bias transistor 110 (e.g., $I_{db}$) and the stabilized transistor 111 (e.g, $I_{dpa}$). The increased drain to source current $I_{db}$ in the bias transistor 110 tends to make the voltage $V_B$, at the drain of the bias transistor 110, more negative (see equation 1 below).

To simplify the discussion it is assumed that (i) the gate leakage currents of the bias transistor 110 and the stabilized transistor 111 are negligible; (ii) the resistor 118=open and the resistor 119=short; and (iii) RL=the resistance of resistor 114. Thus, from FIG. 2:

$$V_B=-I_{db}*(RL) \tag{1}$$

and, since the gate leakage currents are negligible (see assumption (i) above), a voltage ($V_P$) at the gate of the stabilized transistor 111 is:

$$V_P=V_B \tag{2}$$

As mentioned above, if $I_{dpa}$ tends to increase by $\Delta I_{dpa}$ due to a variation in the Vpoff (e.g., Δ Vpoff) of the stabilized transistor 111, $I_{db}$ tends to increase by $\Delta I_{db}$. This increase in $I_{db}$ tends to bring down the potential at the drain of the bias transistor 110 by $\Delta V_B$, equal to:

$$\Delta V_B=-(\Delta I_{db}*(RL)) \tag{3}$$

If $$\Delta V_B=\Delta \text{Vpoff}, \tag{4}$$

the current $I_{dpa}$ stays constant as the effect of the Vpoff variation of the stabilized transistor 111 is counteracted by the gate voltage ($V_P$=$V_B$) variation in the same direction and by supposedly the same amount.

Due to this stabilization, ($V_P$−Vpoff) stays constant causing the current $I_{dpa}$ to remain unaffected by the Vpoff variations. In practice, however, exact cancellation of the Vpoff variations are not possible and $I_{dpa}$ tends to vary to some extent. The objective of any bias stabilization circuit is to keep this variation within tolerable limits.

In equation (3), RL can be seen as a gain factor which "amplifies" a given $\Delta I_{db}$ variation to a desired $\Delta V_B$ that is required to cancel the Vpoff variations. Therefore, for the required "exact" or near perfect cancellation of variations in the $I_{dpa}$, a specific value of RL is needed for a specific value of the nominal $I_{db}$ current. It should be noted that this specific value of RL may not be the same as that required to satisfy equation 1.

This is one of the main shortcomings of the device disclosed in the '235 Patent. Since the potential connected to the second side of the resistors 114 and 118 in the '235 Patent (see FIG. 2) are fixed to a ground potential (0 V), an arbitrary choice of RL is difficult to select. This is because RL also fixes the nominal DC gate potential of the stabilized transistor 111 (see equation 1) which often times is determined from other considerations, such as the required efficiency and linearity expected of a circuit such as a PA.

It can thus be difficult to select a value of RL which gives the required nominal DC bias voltage $V_P$ (see equations 1 and 2) and at the same time achieves the near perfect cancellation of the Vpoff variations (see equations 3 and 4). Still further, this choice of RL may not adequately cancel the fabrication process variations that may also cause the bias stabilization resistors (e.g., the resistors 114, 115, 118 and 119) to change.

A further problem is that the nominal value of the current $I_{db}$ oftentimes cannot be chosen arbitrarily. The negative voltage VGG required for operation of a circuit such as the PA may be generated by a switching inverter circuit. Switching inverter circuits generally only have a limited current sinking capability. In other words, VGG may only be able to sink a small amount of current. Consequently, the nominal value of the current $I_{db}$ must be selected to account for this limitation. Additionally, the variations in VGG may not be shielded enough by the bias transistor 110 if it is not biased properly in the saturation region. In that case, $V_B$ and hence the power amplifier's DC bias current $I_{dpa}$ varies with VGG. Thus, $I_{dpa}$ needs to be stabilized with respect to VGG as well.

Thus, in a multi-constraint environment, such as for a PA, the circuit from the '235 Patent may not adequately compensate for all these variations.

Therefore, it is an object of the present invention to provide a bias stabilization circuit that can adequately compensate for parameter variations such as Vpoff variations, resistance variations in bias resistors, and power supply variations.

Another object of the present invention is to provide an improved method of forming a bias stabilization circuit that can compensate for the above parameter variations.

SUMMARY OF THE INVENTION

These and other objects of the present invention are achieved by a bias stabilization circuit of the present invention. A preferred embodiment of the bias stabilization circuit is comprised of an FET ("the bias transistor") and a novel configuration of bias resistors and power supplies. The bias stabilization circuit stabilizes an FET ("the stabilized transistor") that may be part of another circuit. If the operating point (e.g., the saturation current) of the stabilized transistor varies, the bias transistor will compensate to maintain a substantially constant operating point of the stabilized transistor. Consequently, by stabilizing the stabilized transistor's operating point, the circuit in which the stabilized transistor operates will also be stabilized. For instance, if the stabilized transistor is configured as a power amplifier ("PA"), then the operating characteristics, such as the power and the amplification of the PA, will also be relatively well stabilized.

In the present invention, the bias transistor and the stabilized transistor's electrical characteristics are preferably closely related. In a preferred embodiment of the present invention, the close relationship is achieved by fabricating the bias transistor and the stabilized transistor on the same chip. Additionally, the bias transistor and the stabilized transistor may be fabricated physically close to each other and during the same process.

The present invention stabilizes the operating characteristics of the stabilized transistor by compensating for variations that may occur in the bias and stabilized transistors through the proposed solutions at both the circuit and the system level.

At the circuit level, the bias stabilization circuit of the present invention operates to compensate for Vpoff variations in the bias and stabilized transistors. Further, the circuit of the present invention also may compensate for resistance variations in the bias resistors. The Vpoff variations and the resistance variations may occur from chip to chip and lot to lot during fabrication due to unavoidable process changes.

At the system level, the circuit of the present invention compensates for variations that may occur in the power supplies that are connected to the bias transistor. In a preferred embodiment of the present invention, this is assisted by deriving the negative power supply (VGG) of the bias transistor from the positive power supply (VDD_Bias) of the bias transistor.

In a preferred embodiment, the above may be accomplished by connecting the bias transistor to a load comprising a first resistor, a second resistor, and a third resistor. The first and second resistors are connected in series between a bias power supply and a reference power supply (e.g., a ground potential). A drain of the bias transistor is connected to the first and second resistors through the third resistor. Additionally, the drain of the bias transistor is also connected to a gate of the stabilized transistor. A source of the bias transistor is connected to a negative power supply through a fourth resistor.

If the bias transistor is fabricated to operate in a depletion mode, an embodiment of the present invention may couple a gate of the bias transistor to the junction between the negative power supply and the fourth resistor.

The bias stabilization circuit of the present invention compensates for variations in the power supplies that are used for the bias transistor. A preferred embodiment compensates for the power supply variations by deriving the negative power supply of the bias circuit from the positive bias power supply. In this way, variations in the bias power supply are proportionately reflected in the negative power supply. Additionally, the bias power supply may or may not be derived from a power supply of the stabilized transistor. Deriving the bias power supply from a power supply of the stabilized transistor may help keep the bias transistor in the saturation region. Alternatively, the bias power supply may be derived from a power supply of the stabilized transistor as a matter of convenience.

The circuit of the present invention may be used to stabilize the bias current in ICs such as Microwave Monolithic Integrated Circuits ("MMIC"). The circuit of the present invention may also be used in a variety of circuit applications, such as with a power amplifier ("PA"), with a cascode low-noise amplifier ("LNA"), with a mixer circuit, etc. In an amplifier application, the bias stabilization circuit of the present invention may be employed to set up the quiescent point of the amplifier. To exemplify the usefulness of the present invention, an illustrative case of using the bias stabilization circuit to stabilize a PA is presented below.

Illustratively, the PA may be fabricated using metal semiconductor field effect transistors ("MESFETs") in a GaAs substrate. The circuit technique of the present invention may be applied to achieve similar results in other circuits and for other technologies as well.

For the PA, the bias stabilization circuit of the present invention eliminates the need for the cumbersome and time consuming tuning of the bias circuit which may otherwise be required. The circuit of the present invention operates to counteract the chip-to-chip, wafer-to-wafer and lot-to-lot variations (for brevity, hereinafter referred to as the lot-to-lot variations) of the pinch-off voltage (Vpoff) that may occur due to the fabrication process. The bias stabilization circuit of the present invention compensates for resistance variations in the bias resistors and variations in the power supplies of the bias transistor.

Additionally, the present bias circuit has a relatively small output resistance. Therefore, the circuit of the present invention does not have problems with thermal runaway (see discussion above). This makes the bias circuit of the present invention suitable for a wide range of transistor geometries and operating conditions.

The inventive bias circuit works well with low currents. Therefore, in cases where the bias circuit uses a negative power supply that has limited current sinking capability, the inventive bias circuit is still suitable.

The problem with thermal runaway and availability of negative power supply current are generally present in a PA application. The novel bias stabilization circuit meets the aggressive demands of such an application as well as other less demanding applications, such as a cascode LNA, a mixer, etc.

In any case, the basic requirements to make the stabilized transistors current relatively immune to process variations, such as variations in the Vpoff and bias resistors, and systems variations, such as power supply variations, generally exist in most applications. The bias stabilization circuit of the present invention meets all the above discussed general and special requirements.

BRIEF DESCRIPTION OF THE DRAWINGS

Following is a description of preferred embodiments of the present invention, which when taken in conjunction with the following drawings, will illustrate the above noted features and advantages as well as further ones. It should be expressly understood that the drawings are included for illustrative purposes and do not represent the scope of the present invention.

DETAILED DESCRIPTION OF THE PREFERRED EMBODIMENTS

For clarity of presentation, the detailed description is set out in the following subsections:

I. Overview of the Invention

The invention is briefly described.

II. System Level Solutions

A few system level implementation aspects of an embodiment of the present invention are described. These have influence on the bias stabilization characteristics with respect to the power supply and Vpoff variations.

III. Circuit Level Solutions

A few circuit level implementation aspects of an embodiment of the present invention are described. These have influence on the bias stabilization characteristics with respect to the Vpoff, power supply and resistance variations.

IV. Enhancement Mode Circuit

An embodiment of the present invention is described wherein the bias and stabilized transistors are fabricated to operate in an enhancement mode technology.

V. Computer Simulation Results

Computer simulation data is presented for a preferred embodiment of the present invention.

VI. Conclusion

I. Overview of the Invention

Figure 1:
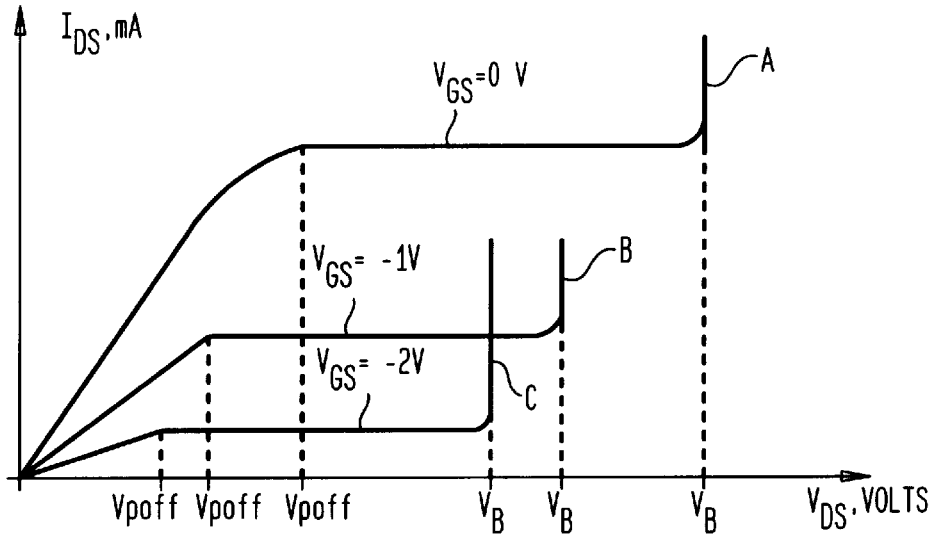
FIG. 1 (PRIOR ART)
FIG. 1 is a graph showing typical current and voltage characteristics for a depletion mode N-channel field effect transistor.
Figure 2:
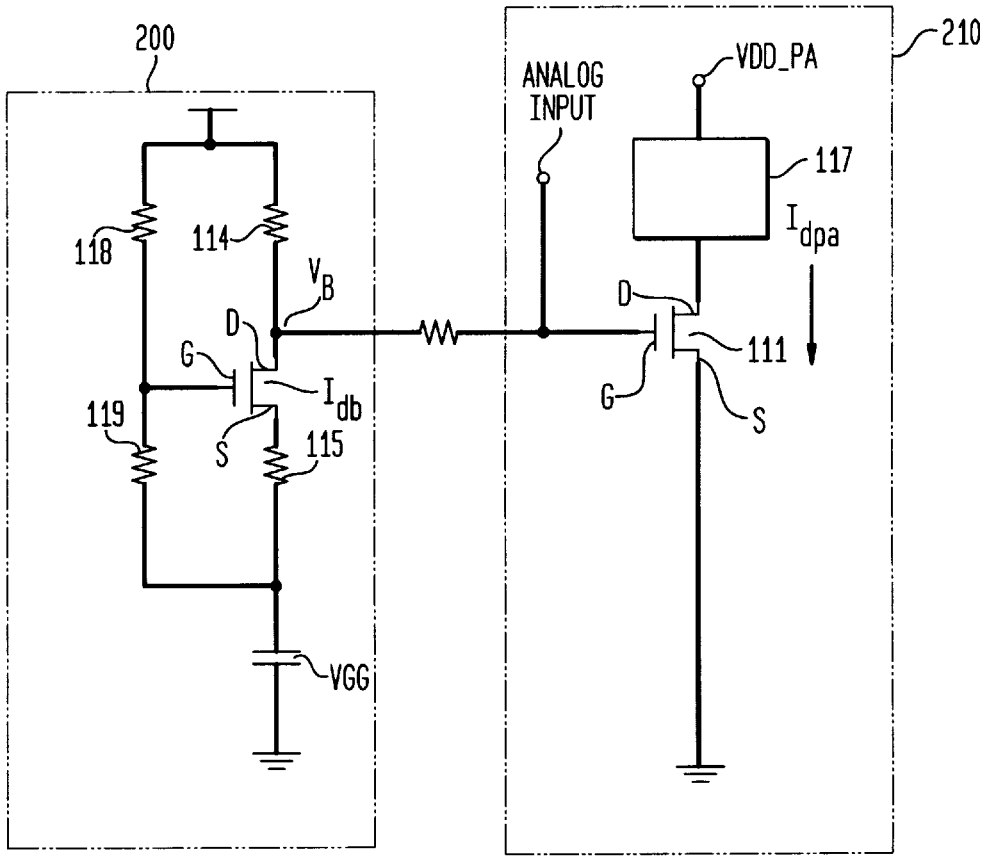
FIG. 2 (PRIOR ART)
FIG. 2 is a schematic diagram of a prior art bias stabilization circuit in a power amplifier application.
Figure 3:
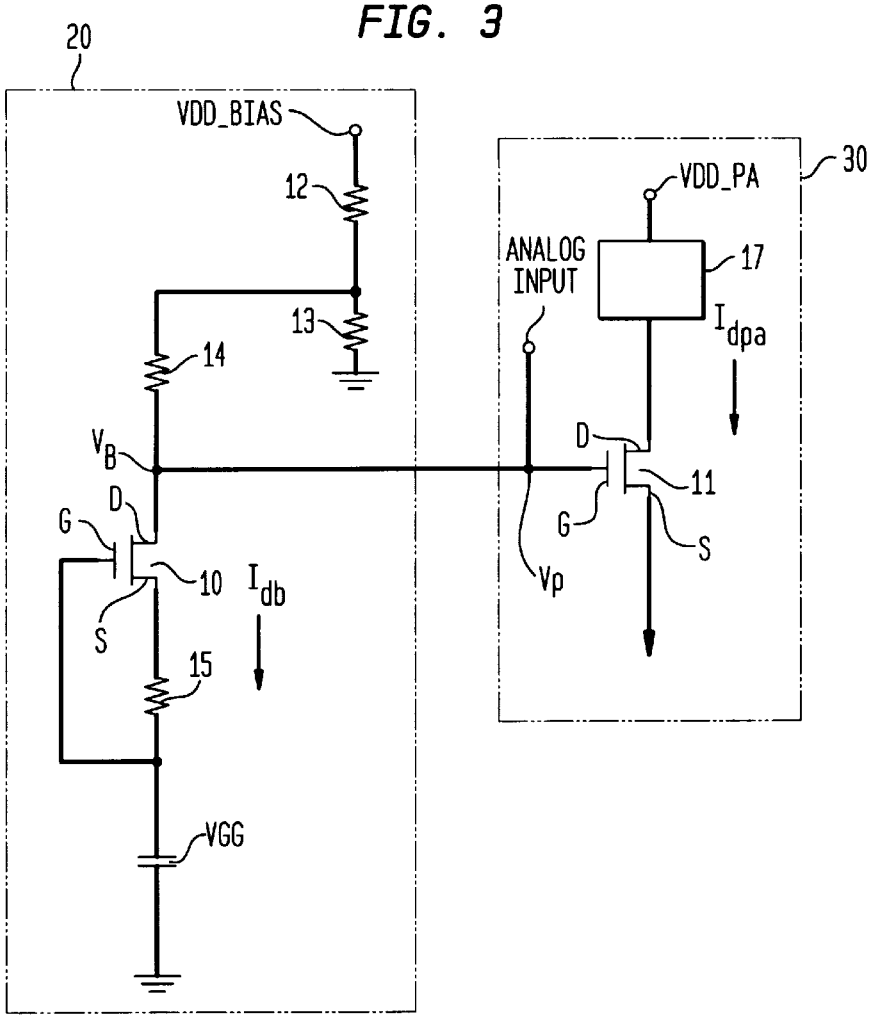
FIG. 3 is a schematic diagram of an embodiment of the present invention.

FIG. 3 shows a schematic diagram of a bias stabilization circuit 20 for a PA 30, in accordance with a preferred embodiment of the present invention. As a result of this novel bias stabilization circuit 20, the saturation current of the PA 30 can be stabilized with respect to both process variations, such as Vpoff variations and resistance variations in the bias resistors, and system variations, such as variations in VDD and VGG of the bias circuit.

As shown in FIG. 3, a preferred embodiment of the present bias stabilization circuit 20 is comprised of a bias transistor 10 and a novel configuration of load resistors (e.g., a resistor 12, a resistor 13, and a resistor 14), and power supplies (e.g., $VDD_{13}$ Bias and VGG). In the present invention, the electrical characteristics of the bias transistor 10 and a stabilized transistor 11, should be closely related. In a preferred embodiment of the present invention, this close relationship is achieved by fabricating the bias transistor 10 and the stabilized transistor 11 on the same chip. Additionally, the bias transistor 10 and the stabilized transistor 11 may be fabricated physically close to each other, with the same orientation, etc., and during the same process.

In a preferred embodiment, the bias transistor 10 is connected to a load comprising resistors 12, 13, 14. The resistors 12, 13 are connected in series. The drain (D) of the bias transistor 10 may be connected to first ends of resistors 12, 13 through the resistor 14. The drain (D) of the bias transistor 10 may also be connected to a gate (G) of the stabilized transistor 11. A second end of the resistor 12 is connected to a bias power supply ("VDD_Bias"). A second end of the resistor 13 is connected to a ground potential. The source (S) of the bias transistor 10 is connected to a negative power supply ("VGG") through a resistor 15.

In configurations where the bias transistor 10 is fabricated to operate in a depletion mode, a gate (G) of the bias transistor 10 may require a negative supply potential. One configuration for achieving a negative potential at the gate (G) of the bias transistor 10 is shown in FIG. 3. In this embodiment, the gate (G) of the bias transistor 10 is coupled to the junction between the negative power supply VGG and the resistor 15.

The novel bias stabilization circuit 20 of the present invention compensates for variations in the power supply potentials. In a preferred embodiment of the bias stabilization circuit, the negative power supply VGG may be derived from the bias power supply VDD_Bias using for instance, an LTC1044A which is available from Linear Technology. In this way, variations in the bias power supply VDD_Bias are proportionately reflected in the negative power supply VGG. In a preferred embodiment, the bias power supply VDD_Bias may be derived from a power supply VDD_PA of the stabilized transistor 11. This can further compensate for the effects of the power supply variations by helping to keep the bias transistor more in the saturation region. In alternate embodiments, |VDD_PA| is generally >|VGG|. Typically, VDD_PA=3.6V, and VGG=−3.0V. In the preferred embodiment, VDD_PA=−VGG=3.6V.

The bias stabilization circuit of the present invention also compensates for variations in the saturation current (e.g., $I_{dpa}$) of a stabilized transistor that may occur due to fabrication process variations. Considering these variations, if in a given circuit configuration, the Vpoff is more negative than a desired Vpoff, the saturation current $I_{dpa}$ in both the stabilized transistor 11 (e.g., $I_{dpa}$) and the bias transistor 10 (e.g, $I_{db}$) increases. The increased current in the bias transistor 10 tends to make a voltage $V_B$ at the drain of the bias transistor 10 more negative.

Assuming that the leakage current in the gate of the stabilized transistor 11 is negligible, a voltage $V_P$ at the gate of the stabilized transistor 11 is equal to the voltage $V_B$. Thus, as the Vpoff of the bias transistor 10 and stabilized transistor 11 becomes more negative, so does the gate voltage $V_P$. This action tends to keep the DC current (e.g., the saturation current) $I_{dpa}$ through the stabilized transistor 11 relatively constant.

In the present inventive circuit, the Vpoff of the two FETs (e.g., both the bias transistor 10 and the stabilized transistor 11) are strongly correlated. Thus, in an embodiment of the inventive bias stabilization circuit, the bias transistor 10 and the stabilized transistor 11 may be fabricated on the same chip and as close to each other as possible.

As shown in FIG. 3, an embodiment of the present invention may isolate the DC bias circuit (e.g., the bias stabilization circuit 20) from the analog operation of the power amplifier circuit 30 by using a resistor 16. The resistor 16 is especially useful to isolate various circuits that are being driven by the same bias stabilization circuit, such as when two stages of a PA are stabilized by a single bias stabilization circuit.

Figure 4:
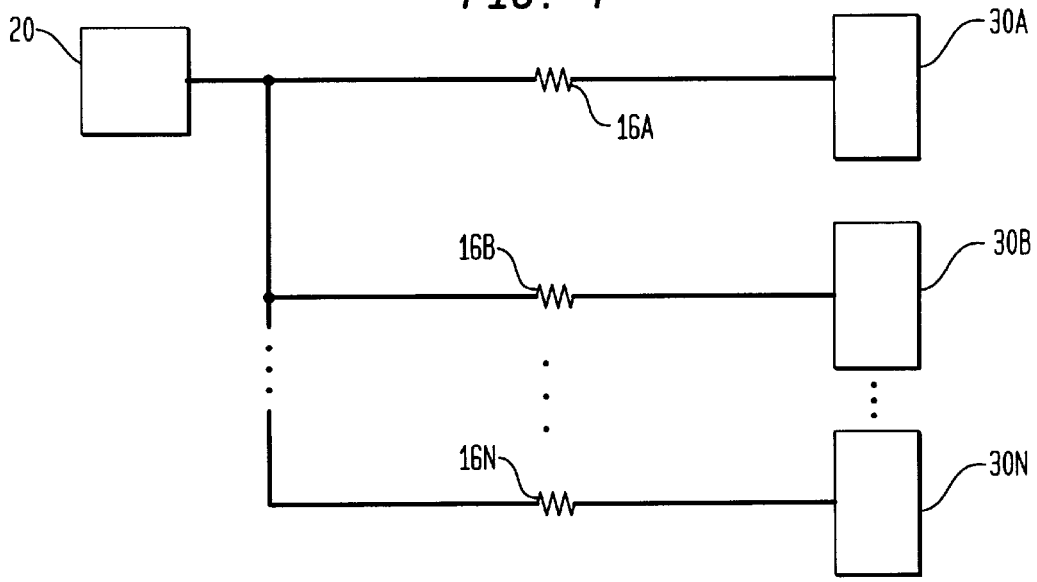
FIG. 4 is a block diagram of an application of the bias stabilization circuit of the present invention biasing multiple circuits.

FIG. 4 shows an embodiment wherein the bias stabilization circuit 20 of the present invention is used to drive "N" stages 30A, 30B, . . . , 30N of an amplifier circuit. In this embodiment, isolating resistors 16A, 16B, . . . , 16N are used to isolate each amplifier stage 30A, 30B, . . . , 30N from the bias stabilization circuit 20.

The operation of the inventive bias stabilization circuit 20 in a multiple circuit application, as shown in FIG. 4, is similar to the operation in a single circuit application as shown in FIG. 3. Therefore, the details of operation of the bias stabilization circuit of the present invention in a multiple circuit application are not discussed in great detail herein. When only one stage's saturation current is to be stabilized by the bias stabilization circuit, the resistor 16 may not be provided. When multiple stages of an amplifier are to be stabilized by a single bias stabilization circuit, as shown in FIG. 4, a transistor from each stage of the amplifier preferably may also be fabricated on the same chip as the bias transistor. In this way, the electrical characteristics of each stage's transistor's may also be closely related to the electrical characteristics of the bias transistor.

Solutions to the above noted process and system variations are disclosed by the novel bias stabilization circuit 20 of the present invention. The solutions are implemented by the present invention at both the system and the circuit level.

II. System Level Solutions (i) In contrast to the teachings of the '235 Patent, a positive power supply VDD_Bias is used on the "load side" of the bias transistor 10 instead of ground potential. For convenience and for the reason described under the point (ii) below, VDD_Bias may be chosen to be the same as VDD_PA. Although, VDD_Bias=VDD_PA is not conceptually necessary for a good operation of the bias stabilization circuit with respect to Vpoff variations. However, as described in (ii) below, this choice can help achieve a better bias stabilization with respect to VGG and VDD_Bias variations.

Additionally, the choice of using a positive power supply VDD_Bias (whether it is equal to VDD_PA or not) coupled with the circuit level solution described in point (iii) below, makes the present proposal more robust and general-purpose in achieving a better overall bias stabilization as compared to the circuit described in the '235 Patent. To be more specific, the preferred embodiment of the present invention may achieve a better overall bias stabilization with respect to Vpoff, VDD_Bias and VGG variations.

(ii) Also at the system level, in an embodiment of the present invention, the negative power supply VGG may be derived from the positive power supply VDD_Bias of the bias circuit. Further, VDD_Bias may be chosen to be derived from the power supply of the stabilized circuit (e.g., VDD_PA). In a preferred embodiment, VDD_Bias may be derived from and equal to VDD_PA. Thus effectively, in the preferred embodiment of the present invention, −VGG=VDD_Bias=VDD_PA, instead of the typical practice of generating VGG from a "regulated" supply of about 3V. For example, since VDD_PA may be typically 3.6 V. Selecting −VGG=VDD_Bias=VDD_PA, results in the negative supply VGG=−3.6 V. For this example, approximately an additional 600 mV is provided to keep the bias transistor 10 in the saturation region. Consequently, the preferred embodiment of the present invention improves the stabilization of $I_{dpa}$ with respect to VGG, since VGG variations can now be shielded more effectively by the bias transistor 10.

III Circuit Level Solutions (iii) At the circuit level, a novel arrangement for the load of the bias transistor 10 is disclosed by the present invention. FIG. 3 shows this novel arrangement of the resistors 12, 13, 14. In this embodiment, the resistors 12, 13 are coupled between the power supply VDD_Bias and a reference potential such as a ground potential.

Figure 5:
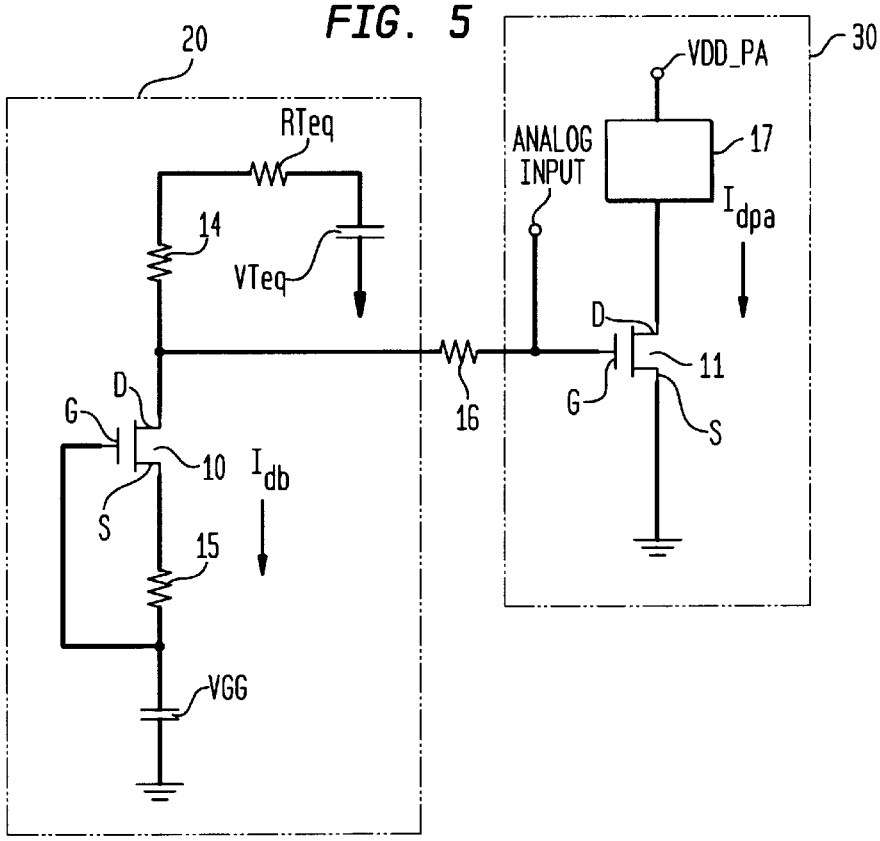
FIG. 5 is a schematic diagram of a Thevenin equivalent circuit for the bias stabilization circuit of the present invention.

FIG. 5 shows a Thevenin equivalent circuit for the circuit shown in FIG. 3. In this circuit, the power supply VDD_Bias, and the resistors 12, 13 provide a Thevenin equivalent voltage Vteq and a Thevenin equivalent resistance Rteq. Thus, the preferred embodiment of the present invention provides several additional factors, such as the Thevenin equivalent voltage Vteq., the resistors 12, 13, 14, and the Thevenin equivalent resistance $R_{teq}$ provided by the resistors 12, 13, that are not available in the prior art (e.g., the '235 Patent). These additional factors help to obtain a desired "gain-factor" RL (see equation 3 above). The additional parameters that have been generated help to obtain a gain-factor that adequately cancels the Vpoff variations by satisfying equations 3 and 4 (see above). At the same time, the additional parameters help obtain a suitable DC gate-bias voltage $V_P$ at the gate of the stabilized transistor 11 by satisfying equations 1 and 2 (see above). The additional parameters influence the bias stabilization achieved not only with respect to the $V_{poff}$ variations but also with respect to the power supply variations as well.

(iv) Again at the circuit level, to achieve the stability of the saturation current $I_{dpa}$ with respect to the resistance variations in the bias resistors, it is desirable that the voltage $V_P$ (see FIG. 3) be stabilized with respect to these variations. A preferred embodiment of the present invention achieves this stability by maintaining the resistor 15 and the overall load of the bias transistor 10 (e.g., RL) in a definite ratio. This helps stabilize the saturation current $I_{dpa}$. In this way, if the resistance of the overall load RL of the bias transistor 10 tends to increase due to process variations, the effect of the corresponding resistor 15 increase tends to cancel the variation of $V_P$, thereby keeping the current $I_{dpa}$ constant. However, since the resistor 15 and the overall load RL of the bias transistor 10 preferably satisfy other constraints as well, it is not always possible to have a definite ratio between them. Additionally, a bias stabilization circuit preferably is stabilized with respect to variations in the bias resistors.

Thus, a preferred embodiment of the present invention splits the overall load of the bias transistor into two parts. One part of the load, e.g., the resistor 14, is fabricated on the chip that the bias and stabilized transistors are fabricated on. The remaining part, comprising the resistors 12, 13 may be fabricated off the chip. In this way, the resistors 12, 13 may be selected so that the effect of process variations on the resistor 14 may be canceled by the matching variations of the resistor 15 which is also fabricated on the same chip. Since in this embodiment, the resistors 12, 13 are fabricated off the chip, precision components can easily be chosen for these resistors to provide a required effective load resistance (e.g., RL).

Whereas the inventive bias circuit has been described with reference to a typical application of stabilizing the DC bias current (e.g., the operating saturation current) of a PA in a depletion mode GaAs technology, the circuit of the present invention can be utilized for other applications such as a cascode LNA, a mixer, etc. where only positive supplies may generally be involved. In an alternate embodiment of the present invention which is suitable for such cases, the power supply VGG may not be equal to (−VDD_Bias). In yet another embodiment of the present invention, the voltage of the power supply VGG may simply be at a ground potential.

Figure 7:
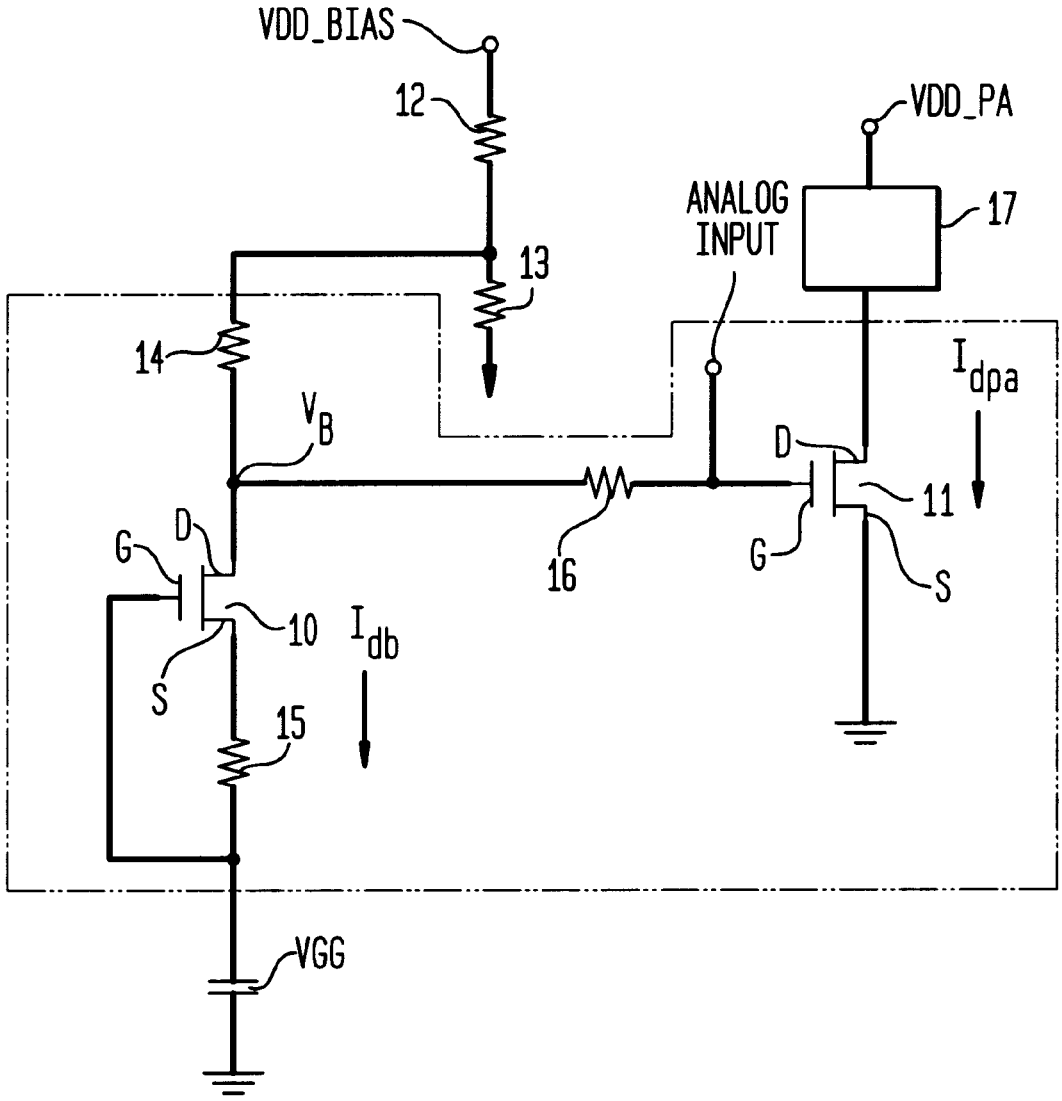
FIG. 7 is a schematic diagram of an embodiment of the present invention indicating which components, in that embodiment, are fabricated on the same chip.

FIG. 7 shows an embodiment of the present invention where the resistors 14, 15 are fabricated on the same chip 50 as the bias transistor 10 and the stabilized transistor 11.

In alternate embodiments of the present invention, other circuit components such as the resistors 12, 13, 14, 15, may or may not be fabricated on the same chip as the bias and stabilized transistors. However, if the resistors 14, 15 are fabricated on the same chip as the bias and stabilized transistors, the pin count of the IC may be reduced and resistance variations in the resistors 14,15 may be more readily compensated (as discussed above).

In an embodiment of the present invention, the resistors 12, 13 may be fabricated on the same chip as the bias and stabilized transistors. However, in this embodiment, it may sometimes be difficult to cancel properly the effect of the resistance variations on the DC bias current of the stabilized circuit.

In an embodiment where the resistors 12, 13 are not fabricated on the same chip as the bias and stabilized transistors, there may be some additional flexibility provided by externally tuning the bias stabilization circuit to further improve the circuit performance. This external tuning may be performed if in a given fabrication process, the Vpoff of the bias and stabilized transistors are found to be correlated, but are not exactly the same, as assumed in the simple analysis discussed above. In that case, the effect of the constant Vpoff offset between the two transistors may be compensated by a suitable change in the selection of the resistors 12, 13. In general, this external tuning may only need be performed as a one time correction for a given fabrication process. Thereafter, no external tuning should be necessary for the lot to lot variations.

As mentioned earlier, the resistor 16 may not be necessary or critical when the bias circuit is used to stabilize the dc current $I_{dpa}$ of only one stabilized transistor 11. However, in an embodiment where the resistor 16 is included in the circuit, it may also be fabricated on the same chip as the bias and stabilized transistors to reduce the pin-count. Otherwise, it is not a critical component for bias-stabilization.

IV. Enhancement Mode Circuit

Figure 6:
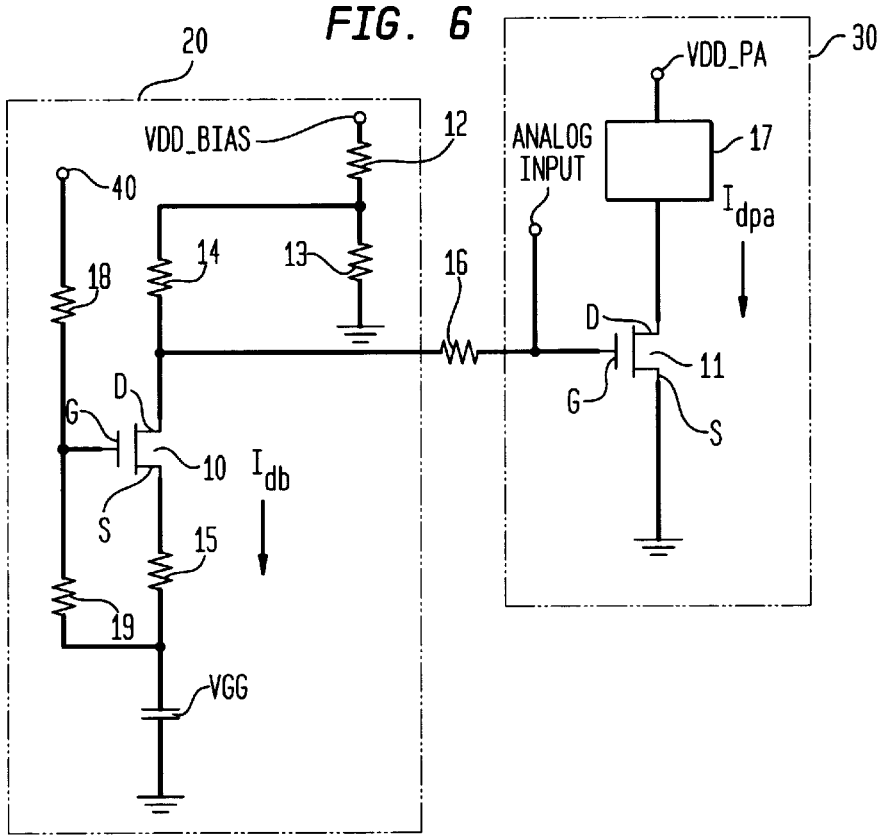
FIG. 6 is a schematic diagram of an alternate embodiment of the present invention.

FIG. 6 shows an alternate embodiment of the inventive bias stabilization circuit of the present invention that may be used with enhancement mode FETs. Typically, an enhancement mode FET operates with a positive gate potential. Therefore, in an embodiment of the present invention, the gate and the source of the bias transistor 10 may not be shorted together. In the embodiment shown in FIG. 6, the gate (G) of the bias transistor 10 is connected to first sides of resistors 18, 19. A second side of the resistor 19 is shown connected to the second side of the resistor 15 and the negative power supply VGG. In this embodiment, the second side of the resistor 18 may, for instance, be connected to a ground or a positive potential through a node 40.

The circuit modification shown in FIG. 6 realizes a positive gate to source voltage for the bias transistor 10. In this embodiment of the present invention, the power supply VGG may not have a negative potential. In one embodiment of the present invention, the power supply VGG may simply be at a ground potential.

In the above illustrative embodiments of the present invention, analog decoupling capacitors may be connected to various nodes. These decoupling capacitors are not shown or described herein. Similarly, small resistors (e.g., a few ohms) are sometimes incorporated in the gate region to suppress the tendency of the circuit to oscillate at high frequencies. These circuit stabilization resistors are also not shown. The decoupling capacitors and the circuit stabilizing resistors generally do not influence the DC bias control aspects of the present invention.

V. Computer Simulation Results

Tables 1 and 2 which follow show the computer simulated performance of a preferred embodiment of the inventive circuit with respect to the variations in the above noted system and process dependent parameters. Since in a preferred embodiment of the present invention, VGG=(−VDD_Bias)=(−VDD_PA), the variations of VGG and VDD_Bias are shown in Tables 1 and 2 as just one variation parameter, VGG. Table 1 shows the simulation results for the case when the bias stabilization circuit drains a current $I_{db}$ of about 2.6 mA. Table 2 shows the simulation results for the case when the bias stabilization circuit drains a current $I_{db}$ of about 2.0 mA. For simplicity, the Tables are generated assuming that the Vpoff of the bias transistor 10 and the stabilized transistor 11 are perfectly correlated and equal.

To generate the tables, the nominal $I_{dpa}$=155 mA was first obtained for the "typical" values of all the parameters. Typical values lie at the "center" of the range. For example, the typical $V_{poff}$=−2.55 V and the typical VGG=−3.6 V. Thereafter, each of the parameters was varied over its full range and maximum deviation was noted at each extreme of the parameter range. This deviation is entered as a ±% of the nominal $I_{dpa}$ in the last column of the Tables.

As shown by both Tables 1 and 2, the bias stabilization circuit of the present invention achieves an excellent bias stabilization with respect to the four system and process variables discussed above. As shown by the simulation data presented in Tables I and II, the maximum variation of the saturation current of the stabilized transistor considering all the noted parameters is within about −6% to +17%. In a case where only $V_{poff}$ is considered as varying (e.g., as in the '235 Patent), then a much smaller variation of the saturation current of the stabilized transistor is obtainable.

TABLE 1

Nominal $I_{dpa}$ = 155 mA, $I_{db}$ =~ 2.6 mA,
Width of the stabilized transistor 11 = 5700 μm,
Width of the bias transistor 10 = 15.5 μm,
resistor 15 = 257 ohms, resistor 14 = 602 Ohms,
resistor 12 = 1800 Ohms, resistor 13 = 1800 Ohms.

| Parameter | Parameter Variation | $I_{dpa}$ Variation ± % |
|---|---|---|
| Vpoff | −(2.2 to 2.9) V | −6.0/+ 17.1% |
| VGG (= −VDD_Bias) | −(3.3 to 3.9) V | 5.2/+ 16.7% |
| R (Internal) | +/− 20% | −1.03/+ 0.88% |
| R (External) | +/− 1% | 4.8/− 4.6% |

TABLE 2

Nominal $I_{dpa}$ = 155 mA, $I_{db}$ =~ 2.0 mA,
Width of the stabilized transistor 11 = 5700 μm,
Width of the bias transistor 10 = 11.5 μm,
resistor 15 = 347.3 ohms, resistor 14 = 827.5 Ohms,
resistor 12 = 2400 Ohms, resistor 13 = 2400 Ohms.

| Parameter | Parameter Variation | $I_{dpa}$ Variation ± % |
|---|---|---|
| Vpoff | −(2.2 to 2.9) V | −6.2/+ 17.2% |
| VGG (= −VDD_Bias) | −(3.3 to 3.9) V | 5.3/+ 16.6% |
| R (Internal) | +/− 20% | 0.13/− 0.04% |
| R (External) | +/− 1% | 4.8/− 4.6% |

While the invention has been described with reference to the preferred embodiments, it will be apparent to those skilled in the art that numerous variations can be made without departing from the spirit or scope of the invention which is defined by the appended claims. For instance, although the above illustrative example utilized the bias stabilization circuit of the present invention to stabilize a PA, the bias stabilization circuit can be utilized in many different applications. The bias stabilization circuit of the present invention can be used in applications for setting up the quiescent point in devices such as a cascode amplifier, multiple gate applications such as a mixer, a multistage power amplifier, or any other application where a quiescent point is required to be stabilized to compensate for lot to lot fabrication variations.

Additionally, although the above illustrative example of the present invention showed stabilizing the bias current in a GaAs power amplifier using MESFET transistors, the present invention can be utilized in many other technologies. For instance, the bias and stabilized transistors may be: Metal Insulator Semiconductor Field Effect Transistors ("MISFETs"); Metal Oxide Semiconductor Field Effect Transistors ("MOSFETs"); Junction Field Effect Transistors ("JFETs"); High Electron Mobility Transistors ("HEMTs"); Modulation Doped Field Effect Transistors ("MODFETs"); Two-Dimensional Electron Gas Field Effect Transistor ("TEGFETs"), etc.

VI. Conclusion

The novel bias-stabilization circuit disclosed in the present invention allows stabilization of the DC bias current of the stabilized circuit with respect to not only the Vpoff variations but also with respect to variations in the power supplies and bias resistors of the bias stabilization circuit. The bias stabilization circuit of the present invention may be used in many applications when it is desirable to stabilize the quiescent point of a transistor for fabrication process variations that may occur from chip-to-chip, wafer-to-wafer, and lot-to-lot. The circuit of the present invention compensates for these variations in many cases without requiring additional tuning of the bias stabilization circuit. In a case where external tuning is desired to compensate for a given fabrication process, the tuning may be performed in the initial setup of the fabrication process. Thereafter, the bias stabilization circuit of the present invention may adequately compensate for the lot to lot variations.

The circuit of the present invention operates to counteract the lot to lot variations of the pinch-off voltage (Vpoff) which may occur due to the fabrication process. The bias stabilization circuit of the present invention compensates for resistance variations in the bias resistors and variations in the power supplies of the bias stabilization circuit.

Additionally, the present bias circuit has a relatively small output resistance. Therefore, the circuit of the present invention does not have problems with thermal runaway.

The bias circuit of the present invention works well with low currents. Therefore, in cases where the bias circuit uses a negative power supply that has limited current sinking capability, the circuit of the present invention is still suitable. The bias stabilization circuit of the present invention meets the aggressive demands of application such as a power amplifier, as well as other less demanding applications, such as a cascode LNA, a mixer, etc. The basic requirements to make the stabilized transistors current relatively immune to process variations, such as variations in the Vpoff and bias resistors, and system variations, such as power supply variations, generally exists in any application. The inventive bias stabilization circuit meets all the above discussed general and special requirements.

In the illustrative embodiments, the present invention is shown biasing a power amplifier implemented in a depletion mode GaAs technology. The circuit of the present invention can be applied to achieve similar results in other circuits and for other technologies as well.

What is claimed is:

1. A bias stabilization circuit for stabilizing an operating point of a first transistor, said bias stabilization circuit comprising:

a second transistor having a gate, a source and a drain, wherein said source is configured to be connected through a first resistor to a first supply potential, said gate is configured to be connected directly to said first supply potential, and said drain is configured to be connected through a resistive load network to a second supply potential;

wherein said drain of said second transistor outputs a bias voltage to the gate of said first transistor, to which it is coupled, such that if there is a change in said operating point of said first transistor, said bias stabilization circuit will automatically adjust said bias voltage to cause said first transistor to return to its original operating point, and wherein said change in said operating point may be caused by variations in said first transistor, said first resistor, said resistive load network, or said first and second spply potentials.

2. The circuit of claim 1, wherein said resistive load network includes a second resistor connected to said drain of said second transistor.

3. The circuit of claim 2, wherein said resistive load is further comprised of:

a third resistor; and a fourth resistor, wherein said third and fourth resistors are connected together in series, and wherein said second resistor is connected to said third and fourth resistors at a junction between said third and fourth resistors.

4. The circuit of claim 2, wherein said first and second resistors are fabricated on a chip.

5. The circuit of claim 2, wherein said first supply potential is derived from a supply potential for said first transistor.

6. A bias stabilization circuit for compensating operating characteristics of a first transistor, said bias stabilization circuit comprising:

a second transistor having a gate, a source and a drain;

a first resistor;

a resistive load connected to said drain of said second transistor through said first resistor, wherein said resistive load is configured to be connected between a first supply potential and a reference potential;

a second resistor connected between said source of said second transistor and a node configured to be connected to a second supply potential, wherein said gate of said second transistor is connected to said node, and wherein said first and second transistors and said first and second resistors are fabricated together on a chip.

7. The circuit of claim 6, wherein said resistive load is comprised of third and fourth resistors connected together in series, and wherein said first resistor is connected to said resistive load at a junction between said third and fourth resistors.

8. The circuit of claim 7, wherein said first and second supply potentials are derived from a supply potential for said first transistor.

9. The circuit of claim 6, wherein said first and second transistors are metal field effect transistors.

10. The circuit of claim 6, wherein said first and second transistors are metal insulator semiconductor field effect transistors.

11. The circuit of claim 6, wherein said first and second transistors are metal oxide semiconductor field effect transistors.

12. The circuit of claim 6, wherein said first and second transistors are junction field effect transistors.

13. The circuit of claim 6, wherein said first and second transistors are high electron mobility transistors.

14. The circuit of claim 6, wherein said first and second transistors are modulation doped field effect transistors.

15. The circuit of claim 6, wherein said first and second transistors are two-dimensional electron gas field effect transistors.

16. A method for fabricating a bias stabilization circuit for stabilizing an operating point of a first transistor, said method comprising the steps of:

fabricating said first transistor and a second transistor concurrently on a chip;

configuring a source of said second transistor to be connected through a first resistor to a first supply potential;

configuring a gate of said second transistor to be connected directly to said first supply potential; and configuring a drain of said second transistor to be connected through a resistive load network to a second supply potential, wherein said drain of said second transistor outputs a bias voltage to the gate of said first transistor, to which it is coupled, such that if there is a change in said operating point of said first transistor, said bias stabilization circuit will automatically adjust said bias voltage to cause said first transistor to return to its original operating point, and wherein said change in said operating point may be caused by variations in said first transistor, said first resistor, said resistive load network, or said first and second supply potentials.

17. The method of claim 16, wherein said first and second resistors are fabricated on said chip.

* * * * *